US010190853B1

(12) United States Patent
Zafar

(10) Patent No.: US 10,190,853 B1
(45) **Date of Patent: *Jan. 29, 2019**

(54) TEXTILE MADE FROM CHAINS AND PROCESS FOR ITS MANUFACTURE

(71) Applicant: Saadia Zafar, New York, NY (US)

(72) Inventor: Saadia Zafar, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/440,926

(22) Filed: Feb. 23, 2017

Related U.S. Application Data

(63) Continuation of application No. 14/322,638, filed on Jul. 2, 2014, now Pat. No. 9,612,090.

(51) Int. Cl.

| | |
|---|---|
| ***B32B 7/08*** | (2006.01) |
| ***F41H 1/02*** | (2006.01) |
| ***D04H 13/02*** | (2006.01) |
| *B32B 15/04* | (2006.01) |
| *D04D 1/04* | (2006.01) |

(52) U.S. Cl.
CPC ..... *F41H 1/02* (2013.01); *D04H 13/02* (2013.01); *D04D 1/04* (2013.01)

(58) Field of Classification Search
CPC ..... C08L 91/06; C08L 29/04; A41D 31/0061; A41D 19/01511; A41D 31/0055; A41D 13/043; C09D 129/04; C09D 191/06; D04B 23/10; D04B 21/165; B32B 2307/581; B32B 2307/5825; B32B 7/08; B21F 31/00
See application file for complete search history.

(56) References Cited

U.S. PATENT DOCUMENTS

| | | | | |
|---|---|---|---|---|
| 2,642,377 | A | 6/1953 | Fetterly | |
| 2,890,579 | A | 6/1959 | Heinrich | |
| 3,030,786 | A | 4/1962 | Heinrich | |
| 3,677,034 | A | 7/1972 | Simpson | |
| 4,192,160 | A | 3/1980 | Duhl et al. | |
| 4,867,086 | A | 9/1989 | Vees et al. | |
| 6,076,190 | A | 6/2000 | Besson | |
| 7,237,272 | B2 | 7/2007 | Bötcher | |
| 7,845,020 | B2 | 12/2010 | Jaunault et al. | |
| 3,069,494 | A1 | 12/2011 | Sundnes | |
| 9,612,090 | B2 * | 4/2017 | Zafar | F41H 1/02 |
| 2003/0056433 | A1 | 3/2003 | Lee et al. | |

(Continued)

FOREIGN PATENT DOCUMENTS

| | | |
|---|---|---|
| CN | 1401274 A | 3/2003 |
| CN | 202149724 U | 2/2012 |

(Continued)

OTHER PUBLICATIONS

Chain. Thesaurus.com Roget's 21st century thesaurus, third edition. Philip Lief Group 2009. http://www.thesaurus.com/browse/chain (accessed: Mar. 1, 2016).

(Continued)

*Primary Examiner* — Bobby Muromoto, Jr.
(74) *Attorney, Agent, or Firm* — Sabety + associates, PLLC; Ted Sabety

(57) ABSTRACT

A system and method is described for easily creating textiles out of chains connected by thread. A dissolvable or removable substrate on which chains can be set is used whereby the thread stitching passes through the substrate. After the textile stitching is completed, the substrate is then removed, including by use of a dissolving solvent or by melting.

16 Claims, 5 Drawing Sheets

(56) References Cited

U.S. PATENT DOCUMENTS

| | | | |
|---|---|---|---|
| 2004/0005341 | A1 | 1/2004 | Dixit et al. |
| 2004/0048109 | A1 | 3/2004 | Granqvist et al. |
| 2005/0080368 | A1 | 4/2005 | Hurwitz |
| 2007/0042210 | A1 | 2/2007 | Horsham |
| 2008/0178786 | A1 | 7/2008 | Butcher |
| 2008/0289087 | A1 | 11/2008 | Sundnes |
| 2010/0089297 | A1 | 4/2010 | Butcher et al. |

FOREIGN PATENT DOCUMENTS

| | | | |
|---|---|---|---|
| EP | 1036868 | A1 | 9/2000 |
| WO | 9957350 | A1 | 11/1999 |

OTHER PUBLICATIONS

Resin. Thesaurus.com Roget's 21st century thesaurus, third edition. Philip Lief Group 2009. http://www.thesaurus.com/browse/resin(accessed: Mar. 1, 2016).

* cited by examiner

TEXTILE MADE FROM CHAINS AND PROCESS FOR ITS MANUFACTURE

PRIORITY CLAIM

This is a utility patent application. This application is a continuation of U.S. patent application Ser. No. 14/322,638, filed on Jul. 2, 2014, which is hereby incorporated by reference in its entirety for all that it teaches.

BACKGROUND OF THE INVENTION

The present invention generally relates to the field of manufacturing textiles using chains as a component. The use of chains as a component of a textile has typically been an industrial process of assembling chain links in both an X and Y orientation in order with separate rings interlocking the individual links in both the X and Y directions. The resulting textile is commonly known as "chain mail." Historical uses of chain mail textile include armor, jewelry, bags, and pot scrubbers. But manufacturing of chain mail requires each link in the chains to accommodate two dimensions of connection. This requires a manufacturing process to start with creating the links in the chain mail. However, chains are typically manufactured with the links in a single, linear direction. The chain mail manufacturing techniques that are known in the art require individually linking each link with separate rings that can be opened and closed with commercially available metalworking tools such as pliers. In addition, many chains may have esthetic appearances that would be beneficial if incorporated into a textile, but in the form of an existing linear chain, cannot be used to create traditional chain mail. Therefore, there is a need for manufacturing a textile out of chains that uses pre-made chains and does not require individual link rings.

BRIEF SUMMARY OF THE INVENTION

The present invention provides a new, novel method and process of manufacturing chains to create a textile. The process involves use of a substrate on which chains can be set with a mounting frame and then interconnected. Once the chains are interconnected, the substrate may be removed from the textile through a method of separation such as dissolving the substrate in the case of a dissolvable substrate or melting the substrate in the case of a wax substrate.

Figure 1:
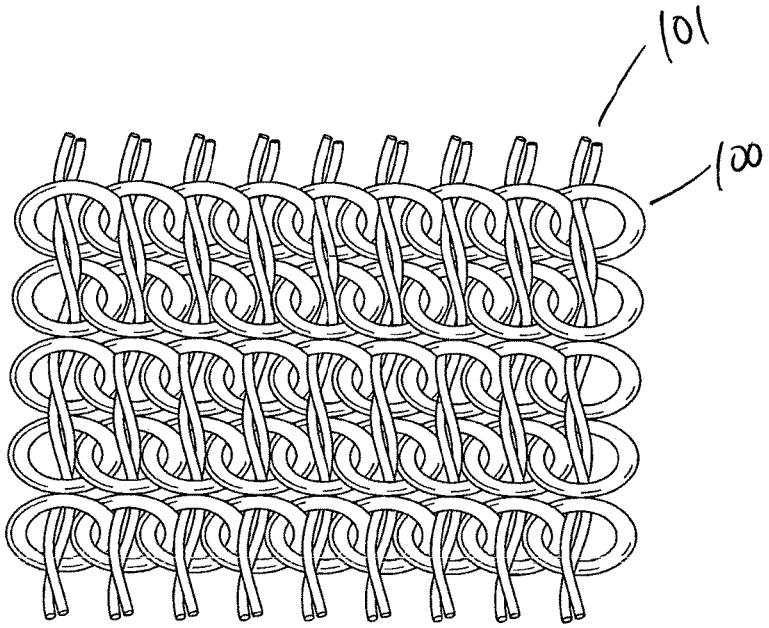
FIG. 1. Top view of finished chain textile.

The headings provided herein are for convenience only and do not necessarily affect the scope or meaning of the claimed invention. In the drawings, the same reference numbers and any acronyms identify elements or acts with the same or similar structure or functionality for ease of understanding and convenience. To easily identify the discussion of any particular element or act, the most significant digit or digits in a reference number refer to the Figure number in which that element is first introduced (e.g., element 204 is first introduced and discussed with respect to FIG. 2).

DETAILED DESCRIPTION OF THE INVENTION

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other features not described in detail herein. Additionally, some well-known structures or functions may not be shown or described in detail below, so as to avoid unnecessarily obscuring the relevant description. The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

Figure 9:
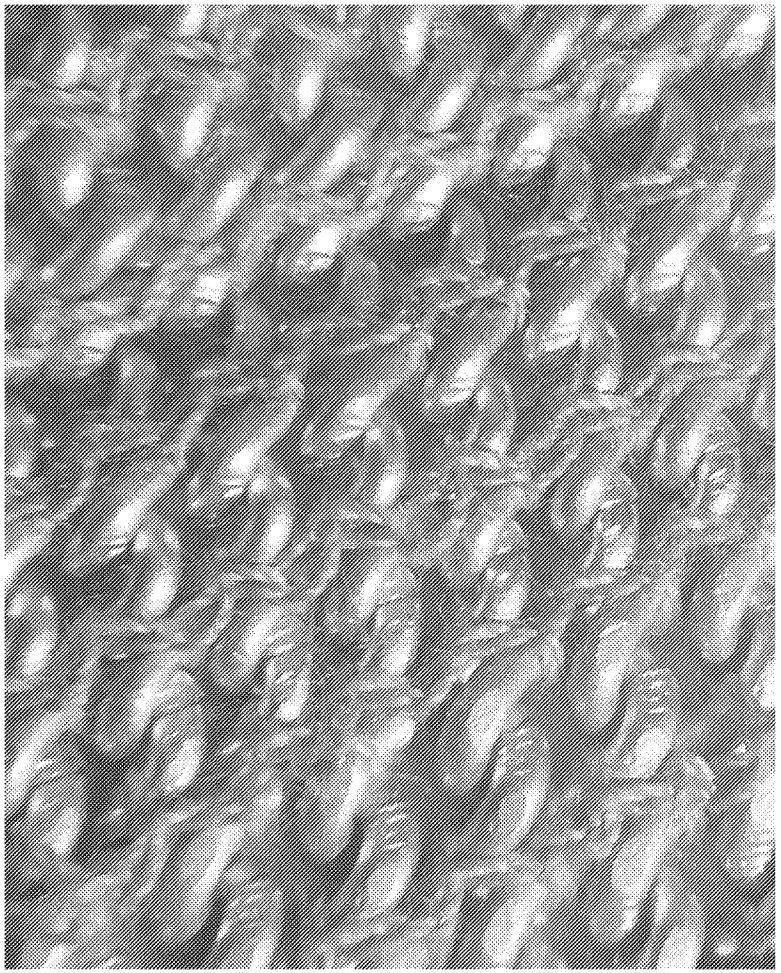
FIG. 9. A close-up photograph of the finished textile.

The chain component is typically a sequence of links, where a given loop of one link has a front and rear neighboring link that loops through the link. The chain component may be comprised of any durable solid material, including but not limited to metal, plastic, glass, rubber, ceramic, or fiber. However, in the textile, the two neighboring chains do not have chain links that connect them on the axis that is normal to the length of the chain. In one embodiment one or more threads pass through the links of neighboring chains so that they are stitched together tightly. As shown in FIG. 1, the chains (100) are bound to each other by means of the threads (101) that run perpendicular to the longitudinal axis of the chains (100). As shown in FIG. 9, the chains may be laid side by side and the threads intertwined with the links in order to form a flexible textile made up of the series of chains. In the preferred embodiment, the chains are selected where the chain links comprising the chains are shaped to lay flat against a planar surface, that is, the loop of the link is shaped to accommodate the intertwined links of its neighboring links along the chains' length. In the preferred embodiment, the thread is comprised of nylon, acetate or other strong materials that are resistant to water or other solvents. For example, these threads may also include cotton, wool, other natural fibers, polyester, rayon, silk, metal, rubber, latex, polypropylene, Kevlar®, Teflon®, or Nomex®, alone or in combination with other materials. In the preferred embodiment, the thread is resistant to the solvent that dissolves the substrate or the head used to melt the wax substrate.

The flexibility of a chain makes it difficult to sew one chain to its neighboring chain reliably and in a manner where the regularity of the link pattern is consistent both along the longitudinal axis of the chains as well as along the axis perpendicular to the chains' longitudinal axis. One object of the invention is to insure the regularity of the chain links comprising the textile in order that it is esthetically pleasing and functional.

In another preferred embodiment, the chain textile is fabricated using a multi-step process. The first step of the process is the selection of a substrate upon which manufacture of the textile takes place. The suitable substrate must be strong enough to withstand stretching in both dimensions along its planar surface without tearing. In addition, it must be sufficiently strong that while in the condition of being stretched, the process of sewing needles penetrating the substrate will not cause the substrate to fail. Finally, the substrate has to be soluble in a solvent or with a relatively low melting point. In the preferred embodiment, the substrate is a resinated paper that is water soluble. Other substrates may be used to accommodate different density of chains.

Figure 2:
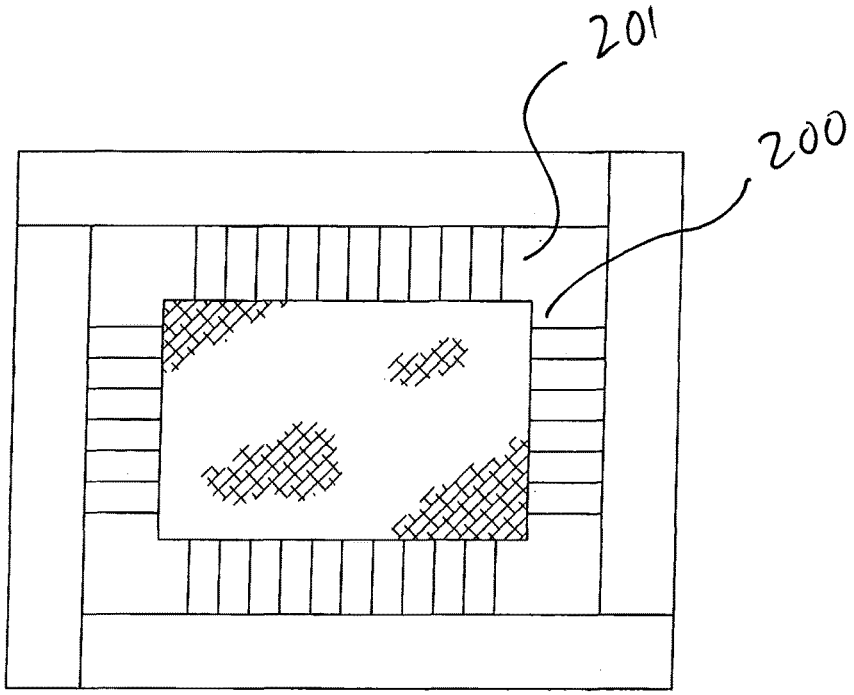
FIG. 2. Top view of substrate held in a mounting frame.
Figure 3:
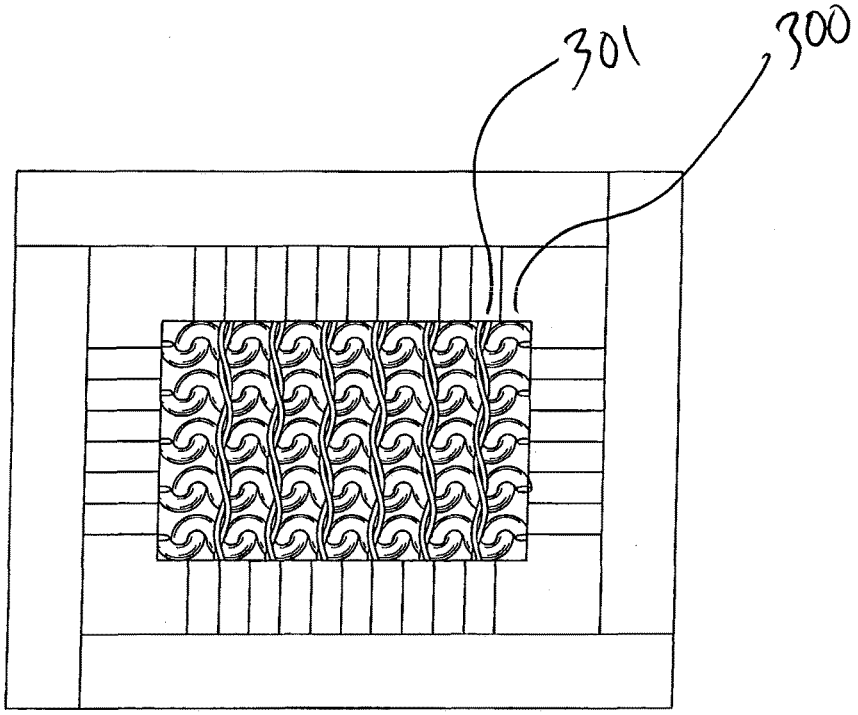
FIG. 3. Top view of finished textile mounted on substrate.
Figure 4:
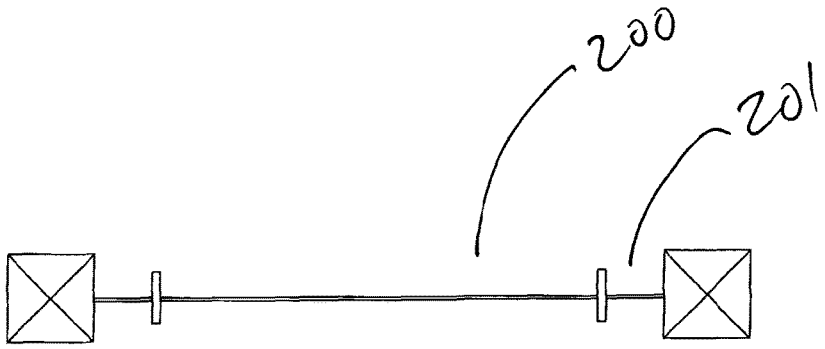
FIG. 4. Side view of the mounting frame with substrate.
Figure 5:
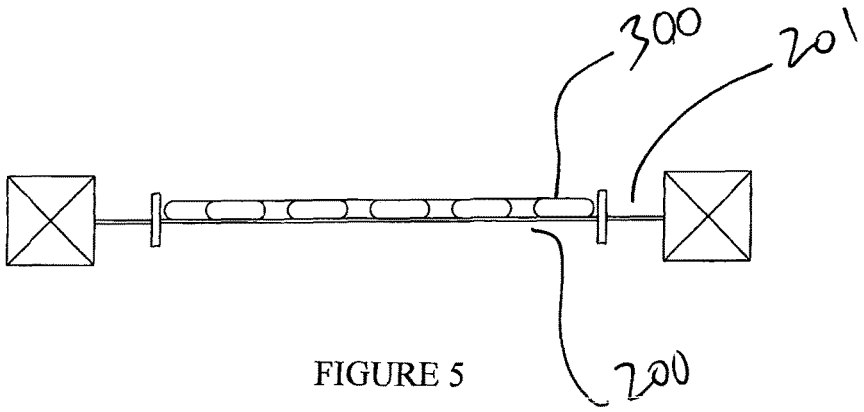
FIG. 5. Side view of the mounting frame with chain laid onto substrate.
Figure 6:
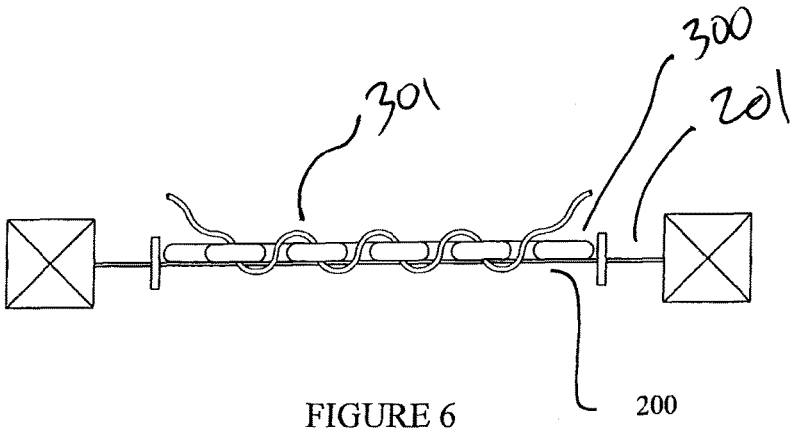
FIG. 6. Side view of the mounting frame with the stitching.
Figure 7:
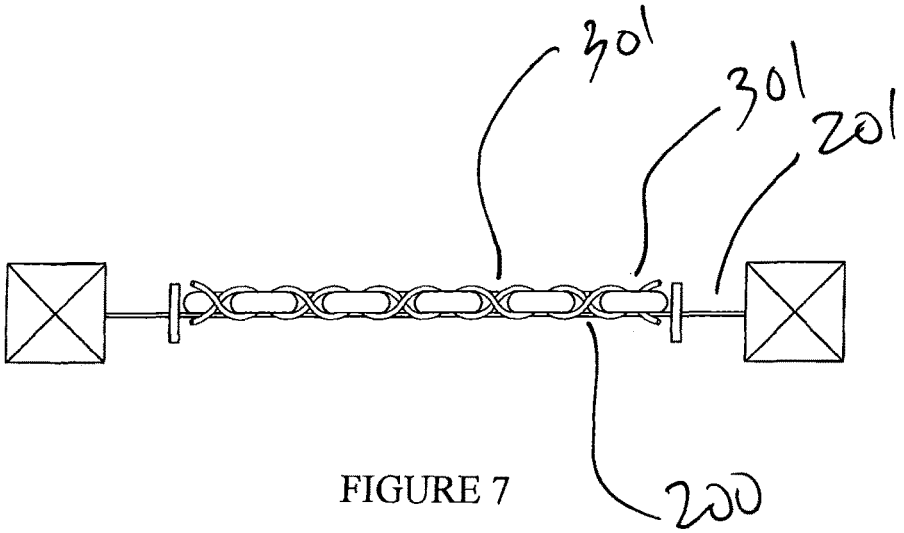
FIG. 7. Side view of the mounting frame with the stitching tightened.

In the first step of the process, the substrate (200) is stretched within a frame, FIG. 2. In one embodiment, a first set of threads (201) are run from the frame to the edges of the substrate and tension applied in order to establish a strong, substantially planar surface for the substrate. FIG. 4 shows a side view of the frame with the substrate. In the second step of the process, the chains (300) are laid out on the substrate side by side. See FIG. 3. FIG. 5 shows a side view of the chains lying on the substrate. In one embodiment, the substrate is marked with registration marks in order to correctly position the chains. In another embodiment, pins are inserted at the end of the chains that pass through the substrate in order that the ends of the chains are fixed. In the third step of the process, a second set of threads (301) are passed through the links of the neighboring chain in order to bind the neighboring chains to the substrate and to each other. FIG. 6 shows a side view of the threading of the chain against the substrate. The thread (301) passes through the hole formed by the chain link, down through the substrate, and then back through the substrate into the next hole formed by the neighboring chain link. In one embodiment, the threads run along the axis perpendicular to the longitudinal axis of the chains. In this embodiment, each new loop of the thread is passing through the next neighboring chain link. In another embodiment, the threads run along a direction at a diagonal to the longitudinal axis of the chains. In either embodiment, threading that runs in both a perpendicular and diagonal direction may be used together. The specific pattern of threading may be varied, so long as the threading establishes that each chain is sufficiently bound to its two neighboring chains, except for the chains at the edge of the textile piece, which are bound to the single neighboring chain. FIG. 7 shows a side view down the longitudinal axis of the chains showing the chains being bound together on the substrate.

Figure 8:
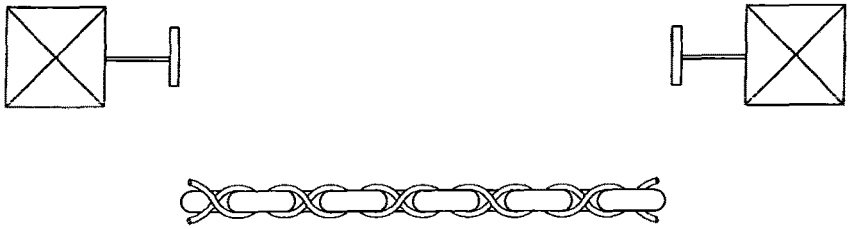
FIG. 8. Side view of the mounting frame after the substrate has been dissolved in a solvent.

In the final step of the manufacturing process, the frame with the substrate and chain textile attached to it is placed into a bath containing a solvent that can dissolve the substrate without damaging either the chains, the chains' finish or the threads. In the preferred embodiment, the solvent is water. After the solvent has dissolved the substrate, all that remains is the manufactured textile piece. FIG. 8. The textile piece may then be cleaned and prepared to be integrated into any kind of garment, jewelry, accessory, luggage or other item that textiles are useful for.

In another embodiment, in the last step of the manufacturing process, the solvent is applied to the substrate and chain textile. Such application can be by various methods, such as pouring, spraying or sponging the solvent onto the substrate. After the solvent has dissolved the substrate, all that remains is the manufactured textile piece. FIG. 8. The textile piece may then be cleaned and prepared to be integrated into any kind of garment, jewelry, accessory, luggage or other item that textiles are useful for.

In another embodiment, the substrate may be a solid substance that can be dissolved or melted. In this embodiment of the invention, the chains may be pressed into the surface of the solid substrate, or the substrate may have channels pressed or otherwise formed in the surface of the substrate. The chains may then be laid into the channels. In one embodiment, the substrate is a wax. This approach permits the chains to be laid in circular or spiral patterns, or patterns involving a corner. Once the chains are laid into the substrate, the threading process is performed to sew the chains together into a textile. At that point, the substrate is removed by means of dissolving the substrate into the solvent or melting the substrate, as in the case of wax. The substrate has to be thin enough so that the thickness of the substrate does not impede the threading process by resisting the movement of the needle, nor introduce slack into the thread stitches when the substrate is removed. In one embodiment, this is accomplished by coating the dissolvable substrate with the solid substrate. In one embodiment, a wax layer is coated on dissolvable paper. In this embodiment, the wax can be patterned with the channels into which the chains are placed. When the textile has been assembled, the paper substrate is dissolved using water. If the water is heated to sufficient temperature above the melting point of wax, any wax residue on the chains can be removed.

It is appreciated that various features of the invention which are, for clarity, described in the context of separate embodiments may also be provided in combination in a single embodiment. Conversely, various features of the invention which are, for brevity, described in the context of a single embodiment may also be provided separately or in any suitable combination. It is appreciated that the particular embodiment described in the specification is intended only to provide an extremely detailed disclosure of the present invention and is not intended to be limiting.

What is claimed:

1. A method for making a textile from a first and second pre-existing chain segments, said chain segments comprised of at least one chain link, said method comprising the steps of:

placing the first and second chain segments of on a substrate, said substrate being substantially planar;

stitching the first and second chain segments together on the substrate using at least one thread where the at least one thread passes through the substrate and through a first link in the first of the chain segment and through a second link in the second chain segment;

and removing the substrate from the stitched chain segments without disturbing the threads.

2. The method of claim 1 wherein the first and second chain segments are comprised of one of metal, plastic, glass, rubber, ceramic, or fiber.

3. The method of claim 1 wherein the thread is comprised of one of cotton, wool, natural fibers, polyester, rayon, silk, metal, rubber, latex, polypropylene, para-aramid, polytetrafluoroethylene, or meta-aramid.

4. The method of claim 1 wherein the substrate is a soluble material.

5. The method of claim 4 wherein the substrate is water soluble.

6. The method of claim 1 wherein the removal step is comprised of dissolving the substrate with a solvent.

7. The method of claim 6 wherein the substrate is water soluble paper.

8. The method of claim 4 wherein the removal step is comprised of dissolving the substrate in a solvent bath.

9. The method of claim 1 wherein the removal step is comprised of heating the substrate to a temperature equal to or higher than its melting point.

10. The method of claim 9 wherein the substrate is comprised of a wax.

11. The method of claim 9 wherein the substrate is comprised of paper coated with wax.

12. The method of claim 11 wherein the removal step is comprised of heating the substrate to a temperature equal to or higher than its melting point while bathed in a solvent.

13. The method of claim 1 further comprising mounting the substrate into a frame.

14. A textile comprising:

a plurality of chain segments where each chain segment is comprised of a plurality of links each interlocking two other links along their corresponding longitudinal axis where said chain segments are connected along an axis perpendicular to the longitudinal axis with threads that pass through the holes of the neighboring links that comprise the neighboring chain segments.

15. The textile of claim 14 wherein the chain segments are comprised of one of metal, plastic, glass, rubber, ceramic, or fiber.

16. The textile of claim 14 wherein the thread is comprised of one of cotton, wool, natural fibers, polyester, rayon, silk, metal, rubber, latex, polypropylene, para-aramid, polytetrafluoroethylene, or meta-aramid.

* * * * *